US008894275B2

(12) United States Patent
Kaelin et al.

(10) Patent No.: US 8,894,275 B2
(45) Date of Patent: Nov. 25, 2014

(54) TIMEPIECE BARREL

(71) Applicant: ETA SA Manufacture Horlogere Suisse, Grenchen (CH)

(72) Inventors: Laurent Kaelin, Sonvilier (CH); Arthur Queval, Lutry (CH); Martin Vautherot, Publier (FR)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/104,199

(22) Filed: Dec. 12, 2013

(65) Prior Publication Data

US 2014/0169141 A1 Jun. 19, 2014

(30) Foreign Application Priority Data

Dec. 18, 2012 (EP) ..... 12197742

(51) Int. Cl.
*G04B 1/16* (2006.01)

(52) U.S. Cl.
CPC ..... *G04B 1/16* (2013.01)
USPC ..... 368/140; 368/143

(58) Field of Classification Search
CPC ..... G04B 1/10; G04B 1/16; G04B 1/18
USPC ..... 368/140–144
See application file for complete search history.

(56) References Cited

U.S. PATENT DOCUMENTS

| | | | | |
|---|---|---|---|---|
| 168,581 | A | 10/1875 | Potter | |
| 978,613 | A * | 12/1910 | Mehl | 368/143 |
| 1,535,684 | A * | 4/1925 | Porter Wilson E et al. | 368/143 |
| 1,561,673 | A | 11/1925 | Ulery et al. | |
| 2010/0278018 | A1 * | 11/2010 | Jouvenot | 368/208 |
| 2011/0222376 | A1 * | 9/2011 | Musy et al. | 368/140 |

FOREIGN PATENT DOCUMENTS

| | | |
|---|---|---|
| CH | 15286 | 4/1898 |
| FR | 1 034 443 | 7/1953 |
| GB | 647819 | 12/1950 |

OTHER PUBLICATIONS

European Search Report issued Jul. 22, 2013 in EP Application 12197742, filed on Dec. 18, 2012 ( with English Translation).

* cited by examiner

*Primary Examiner* — Vit W Miska
(74) *Attorney, Agent, or Firm* — Oblon, Spivak, McClelland, Maier & Neustadt, L.L.P.

(57) ABSTRACT

Timepiece barrel for pivotal assembly between a bottom plate and a bridge and including at least one spring housed between a pivoting drum and a ratchet and hooked between this drum at the outer end thereof and an arbour at the inner end thereof, this arbour pivoting integrally with this ratchet about a pivot axis. This barrel includes a single-piece sub-assembly, coaxial with this arbour and grouping together around a hub, this arbour and this ratchet in immediate proximity to this bottom plate, and which is pivoted on an upper shoulder in a bore of this drum on an end pipe whose outer shoulder pivots in a bore of this bridge or of a jewel comprised in this bridge.

9 Claims, 1 Drawing Sheet

TIMEPIECE BARREL

FIELD OF THE INVENTION

This application claims priority from European patent application No. 12197742.5 filed Dec. 18, 2012, the entire disclosure of which is incorporated by reference.

The invention concerns a timepiece barrel for pivotal assembly between a bottom plate and a bridge and including at least one spring, housed between a pivoting drum and a cover and hooked between said drum at the outer end thereof and an arbour at the inner end thereof, said arbour being pivotally integral with a ratchet about a pivot axis, said barrel including a single-piece sub-assembly coaxial with said arbour and carrying said ratchet and including, on either side of said ratchet, a hub for pivotally guiding said barrel in said bottom plate, said hub forming one end of said arbour.

The invention also concerns a timepiece movement including at least one bottom plate and a bridge and a barrel of this type.

The invention also concerns a watch including a movement of this type. The invention concerns the field of timepiece mechanisms, and more specifically energy storage mechanisms, of the mainspring barrel, striking barrel or similar type.

BACKGROUND OF THE INVENTION

In order to increase the power reserve, by increasing the number of turns of a mainspring, secured at the inner end thereof to a core formed either by an arbour, which is generally cylindrical, or by a more solid hub, one solution consists in decreasing the diameter of the barrel arbour and of the associated hub, so as to increase the space available for the spring inside the drum.

The ratio of the core radius to the spring thickness is usually comprised between 10 and 20 and the invention proposes to reduce this ratio to below 10, and preferably to within a range of between 5 and 10.

The sizing must not be made rashly; there is a risk of breakage if the diameter of the core is too small.

In the conventional barrel architecture, a ratchet is axially mounted on a barrel arbour or on a core, via a square, with the ratchet usually being secured by an axial screw. The dimension of this screw and that of the square thus define the minimum diameter of a pivot shoulder. A step joined to this pivot shoulder limits the axial shake of the arbour or of the core relative to a bottom plate or to a bridge carrying a jewel or similar element.

In particular, it is not sufficient merely to reduce all of the dimensions, since the cross-sections of material are then insufficient to ensure fatigue resistance.

The issue is thus to reconcile the smallest possible diameter, to allow the largest possible power reserve, with rigidity in the ratchet drive.

U.S. Pat. No. 1,561,673 A in the name of Ulery, published in 1925, discloses a barrel with an arbour, and including a collar acting as support for a toothed wheel driving the drum. This arbour includes two housings at its opposite ends, one of which receives a pin for guiding the arbour in a bearing housed in a bottom plate and holding the end of said arbour in said bearing, and the other of which receives a pinned conical peg which has a similar shoulder for upper guiding in a bridge, and, at the distal end thereof, a ratchet drive square.

CH Patent No 15286 A in the name of Danasino, published in 1898, discloses a barrel with a smooth arbour which carries a hollow fusee including a ratchet. This hollow fusee has two shoulders receiving the drum and the cover. The cross-section of the mainspring increases gradually from the outer end towards the inner end thereof.

U.S. Pat. No. 168,581 A in the name of Potter, published in 1875, discloses a barrel with a substantially smooth arbour pivoting at both ends thereof between two plates on either side of a bottom plate in which the barrel is embedded and which forms a cover for the drum. This arbour carries a hollow fusee carrying a wheel and onto which the inner end of the spring is hooked. In abutment on the fusee, the arbour carries the drum onto which the outer end of the spring is hooked. Next, the arbour carries the ratchet, which is in abutment on a small step of the arbour and confined underneath one of the lateral plates.

SUMMARY OF THE INVENTION

The invention proposes to improve the design of known barrels devised for a large power reserve by procuring a high level of rigidity, particularly as regards the ratchet, while maintaining a reduced number of components, and acceptable machining costs, or, preferably, more economical costs than for known barrels.

The invention thus concerns a timepiece barrel for pivotal assembly between a bottom plate and a bridge and including at least one spring, housed between a pivoting drum and a ratchet and hooked between said drum at the external end thereof and an arbour at the inner end thereof, said arbour being pivotally integral with said ratchet about a pivot axis, characterized in that said barrel includes a single-piece sub-assembly coaxial with said arbour and grouping together, about a hub, said arbour and said ratchet, which is located in immediate proximity to said bottom plate, said barrel including a single-piece sub-assembly coaxial with said arbour and carrying said ratchet, and including, on either side of said ratchet, a hub for pivotally guiding said barrel in said bottom plate, said hub forming one end of said arbour, characterized in that said ratchet forms a closing cover of said drum and is placed between said drum and said bottom plate, and in that said single-piece sub-assembly is pivoted on an upper shoulder in a bore comprised in said drum on an end pipe whose external shoulder pivots in a bore in said bridge or in a jewel comprised in said bridge.

According to a feature of the invention, said drum has an upper surface whose travel is limited by a lower surface of said bridge or of a jewel comprised in said bridge, said drum pivots, in a bore comprised therein, on an upper shoulder of said arbour of said single-piece sub-assembly, said ratchet is comprised between, on the one hand a lower end surface of said drum which is located on the opposite side to said upper surface relative to said spring confined in said drum, and on the other hand, a lower step comprised in said single-piece sub-assembly on said hub, said lower step limits the travel of said single-piece sub-assembly relative to said bottom plate or of a jewel comprised in said bottom plate, and a lower shoulder of said single-piece sub-assembly pivots in said bore.

According to another feature of the invention, said single-piece sub-assembly is pivoted on an upper shoulder in a bore in said bridge or in a jewel comprised in said bridge.

According to another feature of the invention, said single-piece sub-assembly includes, on said arbour, a shoulder for receiving said spring which has a larger diameter than said upper end shoulder which extends it, on the opposite side to said ratchet, and, between said receiving shoulder and said upper shoulder, said arbour has a step arranged to cooperate in abutment with an inner surface of said drum, said inner surface is in proximity, on the opposite side of the same flange of said drum, to an upper surface of said drum, whose travel is limited by a bottom surface of said bridge or of a jewel comprised in said bridge.

According to another feature of the invention, said arbour includes a shoulder which has a smaller diameter than that of said hub, and carries said spring, either on said shoulder onto which said spring is friction fitted or welded, or on a hook comprised in said arbour around said shoulder, and said hub includes, in proximity to said ratchet, a shoulder pivoting in a bore in said bottom plate or in a jewel comprised in said bottom plate.

According to yet another feature of the invention, the shake of said drum is limited in lower abutment relative to said bridge, by an upper surface of said drum which is limited by a lower surface of said bridge or of a jewel comprised in said bridge, the shake of said drum is limited in upper abutment relative to said ratchet, by a lower end surface of said drum which is located on the opposite side to said upper surface relative to said spring confined inside said drum, said lower end surface, which is limited by an upper surface of said ratchet of said single-piece sub-assembly, the shake of said ratchet is limited in upper abutment relative to said bottom plate, by a lower surface of said single-piece sub-assembly which is limited by an upper surface of said bottom plate or of a jewel comprised in said bottom plate.

According to yet another feature of the invention, said spring is made of a multiphase, cobalt-nickel-chromium based alloy, comprising 44 to 46% cobalt, 20 to 22% nickel, 17 to 19% chromium, 4 to 6% iron, 3 to 5% tungsten, 3 to 5% molybdenum, 0 to 2% titanium, 0 to 1% beryllium, and having a Young's modulus of between 200 and 240 GPa and a shearing modulus of between 80 and 100 GPa, said spring has a width to thickness ratio of between 3 and 23, and the ratio between the maximum radius of a bearing shoulder of the spring of said arbour and the thickness of said spring is between 3 and 9.

The invention also concerns a timepiece movement including at least one bottom plate and a bridge and a barrel of this type.

The invention also concerns a watch including a movement of this type.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
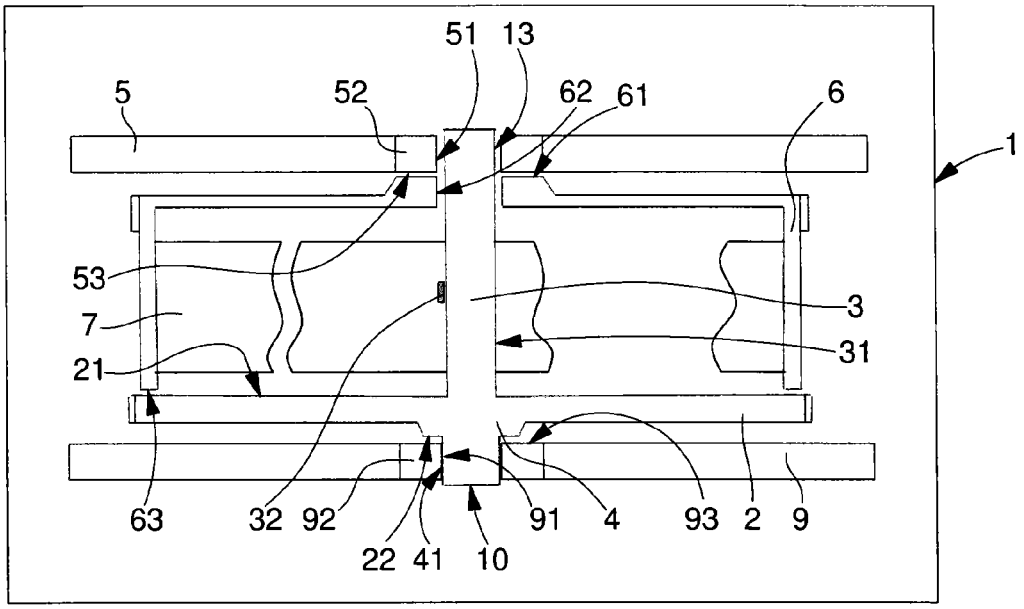
FIG. 1 shows a schematic cross-section of a barrel according to a first variant of the invention through the pivot axis thereof.

The invention concerns the field of timepiece mechanisms, and more specifically energy storage mechanisms, of the mainspring barrel, striking barrel or similar type.

The invention thus concerns a timepiece barrel 1 for pivotal assembly between a bottom plate 9 and a bridge 5 and includes at least one spring 7. This spring 7 is housed between a pivoting drum 6 and a ratchet 2 and is hooked between drum 6, at the outer end thereof, and an arbour 3, at the inner end thereof. Arbour 3 is mounted to pivot integrally with a ratchet 2 about a pivot axis D.

Barrel 1 includes a single-piece sub-assembly 10 coaxial with arbour 3 and grouping together, about a hub 4, at least ratchet 2 and arbour 3. This single-piece sub-assembly 10 carries ratchet 2 and includes, on either side of ratchet 2, said hub 4 which pivotally guides barrel 1 in bottom plate 9. Hub 4 forms one end of arbour 3.

According to the invention, ratchet 2 forms a closing cover for drum 6 and is placed between drum 6 and bottom plate 9; ratchet 2 is located in immediate proximity to bottom plate 9 and closes the chamber delimited by drum 6 about spring 7.

This single-piece sub-assembly 10 is pivoted on an upper shoulder 13 in a bore 51 of bridge 5 or of a jewel 52 comprised in bridge 5.

In the first variant of FIG. 1, single sub-assembly 10 does not have an upper step.

Figure 2:
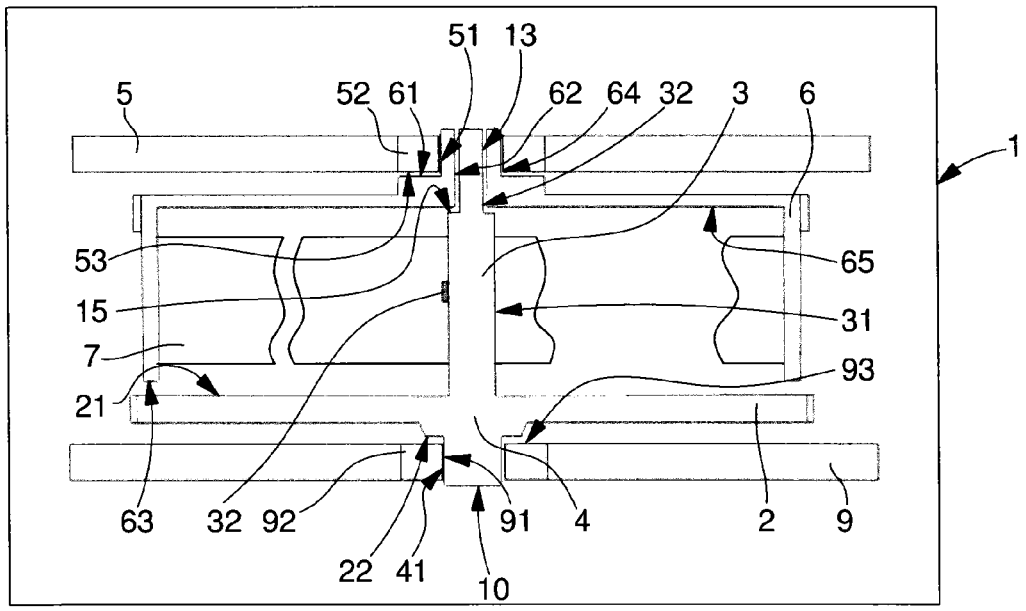
FIG. 2 shows a schematic cross-section of a barrel according to a second variant of the invention through the pivot axis thereof.
Figure 3:
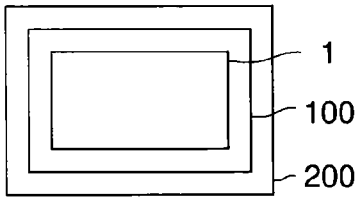
FIG. 3 shows a block diagram of a timepiece including a movement which includes a barrel according to the invention.

In the second variant of FIG. 2, single-piece sub-assembly 10 has an upper step 15, whose travel is limited by a bottom surface 65 of drum 6.

Ratchet 2 is comprised between, on the one hand, a shoulder 31 of arbour 3, where spring 7 is fixed to arbour 3, and on the other hand, a lower step 22 comprised in single-piece sub-assembly 10 on hub 4. This lower step 22 limits the travel of the single-piece sub-assembly 10 in abutment on an upper surface 93 of bottom plate 9 or of a jewel 92 comprised in bottom plate 9.

Drum 6 has an upper surface 61 whose travel is limited by a lower surface 53 of bridge 5 or of a jewel 52 comprised in bridge 5.

Drum 6 pivots, in a bore 62 comprised therein, on an upper shoulder 13 of arbour 3 of single-piece sub-assembly 10.

Ratchet 2 is arranged between, on the one hand, a lower end surface 63 of drum 6 which is situated on the opposite side to said upper surface 61 relative to spring 7 confined inside said drum 6, and on the other hand, this lower step 22 comprised in single-piece sub-assembly 10 on hub 4.

Bottom plate 9, or jewel 92 comprised therein, includes a bore 91, in which a lower shoulder 41 of single-piece sub-assembly 10 pivots.

In the second variant of FIG. 2, the single-piece sub-assembly 10 is pivoted in an upper shoulder 13 in a bore 62 comprised in drum 6 on an end pipe, an outer shoulder 63 of which pivots in a bore 51 of bridge 5 or of a jewel 52 comprised in bridge 5.

In the second variant of FIG. 2, single-piece sub-assembly 10 includes, on arbour 3, a shoulder 31 for receiving spring 7 which has a larger diameter than upper end shoulder 13 which extends said shoulder 31, on the side opposite ratchet 2. This arbour 3 includes, between receiving shoulder 31 and upper shoulder 13, a step 15 arranged to cooperate in abutment with the inner surface 65 of drum 6. This inner surface 65 is in proximity, on the opposite side of the same flange 66 of drum 6, to an upper surface 61 whose travel is limited by a lower surface 53 of bridge 5 or of a jewel 52 comprised in bridge 5.

Arbour 3 has a shoulder 31 whose diameter is preferably smaller than that of hub 4 on a lower shoulder 41 of single-piece sub-assembly 10 and carries spring 7, either on said shoulder 31, onto which spring 7 is friction fitted or welded, or on a hook 32 comprised in arbour 3 around shoulder 31.

Hub 4 includes, in proximity to ratchet 2, a shoulder 41 pivoting in a bore 91 of bottom plate 9 or of a jewel 92 comprised in bottom plate 9.

The shake of drum 6 is limited in upper abutment relative to bridge 5, by an upper surface 61 of drum 6, which is limited by a lower surface 53 of bridge 5 or of a jewel 52 comprised in bridge 5.

The shake of drum 6 is limited in upper abutment relative to ratchet 2 by a lower end surface 63 of drum 6 which is located on the opposite side to upper surface 61 relative to spring 7 confined inside drum 6. This lower end surface 63 is limited by an upper surface 21 of ratchet 2 of single-piece sub-assembly 10.

The shake of ratchet 3 is limited in upper abutment relative to bottom plate 9 by a lower surface 22 of single-piece sub-assembly 10 which is limited by an upper surface 93 of bottom plate 9 or of a jewel 91 comprised in the bottom plate.

In short, the first variant of FIG. 1 is advantageous since single-piece sub-assembly 10 unites the functions of cover, ratchet, arbour and hub, with no machining complexity with the exception of hooking hook 32 of spring 7. There are three shake corrections. The upper surface 21 of ratchet 2, intended to cooperate with the lower surface 63 of drum 6 may advantageously be subjected to a Teflon, "Rilsan®" or similar coating, to reduce the friction torque between drum 6 and ratchet 2. The advantage of this construction is that there is no limit to the diameter of the hub. In the second variant of FIG. 2, the hub diameter is limited by the diameter of the pivot shoulder in bridge 5.

The mainspring may be made of various materials: carbon steel, stainless steel, "Nivaflex®", silicon, DLC, quartz, glass or similar. In a particular application, spring 7 is made of a multiphase, cobalt-nickel-chromium based alloy, comprising 44 to 46% cobalt, 20 to 22% nickel, 17 to 19% chromium, 4 to 6% iron, 3 to 5% tungsten, 3 to 5% molybdenum, 0 to 2% titanium, 0 to 1% beryllium, and having a Young's modulus of between 200 and 240 GPa and a shear modulus of between 80 and 100 GPa. This spring 7 preferably has a width to thickness ratio comprised between 3 and 23, and more particularly between 9 and 21.

Also, the maximum radius of shoulder 31 of arbour 3 (not taking account of any excess thickness of a hook 32), made of steel or stainless steel, for example of 4C27A hardenable steel (also called according to the various standards 1.4197, ASTM 420F, or DIN X22 CRMoNiS 13 1), relative to pivot axis D is less than nine times the maximum thickness of spring 7. In particular, with the illustrated embodiments it is possible to obtain a ratio of the maximum radius of shoulder 31 of arbour 3 to the thickness of spring 7 of between 3 and 9, and preferably between 4 and 6, preferably close to five.

The invention also concerns a timepiece movement 100 including at least one bottom plate 9 and a bridge 5 and a barrel 1 of this type.

The invention also concerns a watch 200 including a movement 100 of this type.

What is claimed is:

1. A timepiece barrel for pivotal assembly between a bottom plate and a bridge and comprising at least one spring, housed between a pivoting drum and a ratchet and hooked between said drum at the outer end thereof and an arbour at the inner end thereof, said arbour being pivotally integral with said ratchet about a pivot axis, said barrel including a single-piece sub-assembly coaxial with said arbour and carrying said ratchet and including, on either side of said ratchet, a hub for pivotally guiding said barrel in said bottom plate, said hub forming one end of said arbour, wherein said ratchet forms a closing cover of said drum and is placed between said drum and said bottom plate, and in that said single-piece sub-assembly is pivoted on an upper shoulder in a bore in said drum on an end pipe whose external shoulder pivots in a bore of said bridge or of a jewel in said bridge.

2. The barrel according to claim 1, wherein said drum has an upper surface whose travel is limited by a lower surface of said bridge or of a jewel in said bridge, in that said drum pivots, in a bore therein, on an upper shoulder of said arbour of said single-piece sub-assembly, in that said ratchet is between a lower end surface of said drum which is located on the opposite side to said upper surface relative to said spring confined inside said drum, and a lower step in said single-piece sub-assembly on said hub, said lower step limits travel of said single-piece sub-assembly relative to said bottom plate or a jewel in said bottom plate, on a bore of said bottom plate or a jewel in said bottom plate and a lower shoulder of said single-piece sub-assembly pivots in said bore.

3. The barrel according to claim 1, wherein said single-piece sub-assembly is pivoted on an upper shoulder in a bore of said bridge or of a jewel in said bridge.

4. The barrel accordingly to claim 1, wherein said single-piece sub-assembly includes, on said arbour, a shoulder for receiving said spring which has a larger diameter than said upper shoulder which extends said shoulder, on the opposite side to said ratchet, and in that between said receiving shoulder and said upper shoulder, said arbour has a step arranged to cooperate in abutment with an inner surface of said drum, said inner surface is in proximity, on the opposite said of the same flange of said drum, to an upper surface of said drum, whose travel is limited by a lower surface of said bridge or of a jewel in said bridge.

5. The barrel according to claim 1, wherein said arbour includes a shoulder which has a smaller diameter than that of said hub on a lower shoulder of said single-piece sub-assembly, and carries said spring, either on said shoulder onto which said spring is friction fitted or welded, or on a hood in said arbour around said shoulder, and in that said hub includes, in proximity to said ratchet, a shoulder pivoting in a bore in said bottom plate or in a jewel in said bottom plate.

6. The barrel according to claim 1, wherein the shake of said drum is limited in lower abutment relative to said bridge, by an upper surface of said rum, which is limited by a lower surface of said bridge or of a jewel in said bridge, in that the shake of said drum is limited in upper abutment relative to said ratchet, by a lower end surface of said drum which is located on the opposite side of said upper surface relative to said spring confined inside said drum, said lower end surface which is limited by an upper surface of said ratchet of said single-piece assembly, in that the shake of said ratchet is limited in upper abutment relative to said bottom plate, by a lower surface of said single-piece sub-assembly, which is limited by an upper surface of said bottom plate or of a jewel in said bottom plate.

7. The barrel according to claim 1, wherein said spring is made of a multiphase, cobalt-nickel-chromium based alloy, comprising 44 to 46% cobalt, 20 to 22% nickel, 17 to 19% chromium, 4 to 6% iron, 3 to 5% tungsten, 3 to 5% molybdenum, 0 to 2% titanium, 0 to 1% beryllium, and having a Young's modulus of between 200 and 240 GPa and a shear modulus of between 80 and 100 GPa, in that said spring has a width to thickness ratio of between 3 and 23, and in that the ratio between the maximum radius of a bearing shoulder of the spring of said arbour and the thickness of said spring is between 3 and 9.

8. A timepiece movement including at least one bottom plate and a bridge and a barrel according to claim 1.

9. A watch including a movement according to claim 8.

* * * * *